US009167924B2

(12) United States Patent
Chen

(10) Patent No.: US 9,167,924 B2
(45) Date of Patent: Oct. 27, 2015

(54) ERGONOMICAL PILLOW FOR HEAD REST

(71) Applicant: Forsound Corp., Kaohsiung (TW)

(72) Inventor: Fu-Chieng Chen, Kaohsiung (TW)

(73) Assignee: Forsound Corp., Kaohsiung (TW)

( * ) Notice: Subject to any disclaimer, the term of this patent is extended or adjusted under 35 U.S.C. 154(b) by 0 days.

(21) Appl. No.: 14/324,368

(22) Filed: Jul. 7, 2014

(65) Prior Publication Data

US 2014/0317852 A1 Oct. 30, 2014

Related U.S. Application Data

(63) Continuation-in-part of application No. 13/566,419, filed on Aug. 3, 2012, now abandoned.

(51) Int. Cl.
*A47G 9/10* (2006.01)

(52) U.S. Cl.
CPC ..... *A47G 9/109* (2013.01); *A47G 2009/1018* (2013.01)

(58) Field of Classification Search
CPC ..... A47G 9/10; A47G 2009/1018
USPC ..... 5/636, 632, 630, 419; 128/845
See application file for complete search history.

(56) References Cited

U.S. PATENT DOCUMENTS 3,616,470 A * 11/1971 Young et al.
5,018,231 A * 5/1991 Wang ..... 5/636
D388,650 S * 1/1998 Davis ..... D6/601
5,781,947 A * 7/1998 Sramek ..... 5/636
5,926,880 A * 7/1999 Sramek ..... 5/636
6,006,380 A 12/1999 Sramek
6,182,316 B1 * 2/2001 Thomas et al. ..... 5/722
6,408,468 B1 * 6/2002 Comfort ..... 5/636
6,622,325 B1 * 9/2003 Garza ..... 5/636
6,629,324 B1 * 10/2003 Shapiro ..... 5/636
6,895,619 B1 * 5/2005 Lee ..... 5/636
7,082,633 B1 * 8/2006 Maarbjerg ..... 5/636
7,213,280 B2 * 5/2007 Lavin et al. ..... 5/636
7,461,421 B1 * 12/2008 Faircloth et al. ..... 5/639
7,735,169 B2 * 6/2010 Wassilefsky ..... 5/636
7,930,782 B2 * 4/2011 Chen ..... 5/655.5
8,028,360 B2 * 10/2011 Regan et al. ..... 5/645
8,161,588 B1 * 4/2012 Anson ..... 5/636
8,176,586 B2 * 5/2012 Berke et al. ..... 5/636
8,176,921 B2 * 5/2012 Bazargani ..... 128/848
8,205,286 B1 * 6/2012 Diaz ..... 5/735
2005/0223493 A1 * 10/2005 Setokawa et al. ..... 5/636
2008/0271250 A1 * 11/2008 Poppe ..... 5/645

(Continued)

*Primary Examiner* — David E Sosnowski
*Assistant Examiner* — Eric Kurilla
(74) *Attorney, Agent, or Firm* — WPAT, P.C.; Anthony King

(57) ABSTRACT

An ergonomical pillow for head rest, comprising: a pillow surface, a pillow, a shock absorbing and pressure relief cushion, the pillow surface and the pillow are made from soft buffer material, the pillow has at least one hollow pore, the shock absorbing and pressure relief cushion covers top of the hollow pore, the pillow surface covers top of the shock absorbing and pressure relief cushion. The pillow surface and shock absorbing and pressure relief cushion can settle into a groove, where the level of which is subject to user's weight, to provide appropriate support for a body type. The present invention provides excellent extent for coverage and user's head positioning such that the head and neck are settled in a proper position, and guides user to rest his/her shoulder near bottom edge of the pillow to avoid neck muscle spasm, and can offer equalized pressure relief.

9 Claims, 8 Drawing Sheets

(56) References Cited

U.S. PATENT DOCUMENTS

| | | | | |
|---|---|---|---|---|
| 2010/0011508 | A1* | 1/2010 | Rubio | 5/632 |
| 2011/0094033 | A1* | 4/2011 | Lee | 5/636 |
| 2012/0023676 | A1* | 2/2012 | Hansen | 5/636 |
| 2012/0073057 | A1* | 3/2012 | Sramek | 5/645 |
| 2012/0079659 | A1* | 4/2012 | Loos | 5/636 |
| 2013/0036555 | A1* | 2/2013 | Weilert | 5/632 |
| 2013/0047338 | A1* | 2/2013 | Lin | 5/636 |
| 2013/0047339 | A1* | 2/2013 | Kim | 5/637 |

* cited by examiner

ERGONOMICAL PILLOW FOR HEAD REST

This application is a continuation-in-part of U.S. patent application Ser. No. 13/566,419 filed on Aug. 3, 2012.

BACKGROUND OF THE INVENTION

1. Field of the Invention

The present invention generally relates to a pillow for head rest, particularly to an ergonomical pillow for head rest wherein the pillow can be used to stabilize movement of user's head and provide appropriate support to user according to his/her body type.

2. Description of Related Art

Humans spend on average one-third of his/her whole lives for sleeping. Researches have shown that sleep quality may take toll on our health, for an example demonstrating such discovery, sleep has been confirmed to be the best way to regain vitality, and sufficient amount of sleep is instrumental to youth's growth. Our brain continues to give instructions during our sleep time to different parts of our body for self-regeneration in order to sustain their normal functions. As well, our brain can also put together the information and knowledge we hear and learn during the day, and restructure them so as to formulate a memory block. In summary, sleep is an indispensable and essential component of our daily lives and health, and excellent sleep quality is instrumental to maintaining a good health.

Among other possible attributing factors to sleep quality, the pillow quality itself can be an important one. However, it is to be noted here that the Chinese proverbial saying that goes as "sleeping high on tall pillow keeps worry away" is actually a misleading conception. Under normal conditions, the human body is more adaptable to maintaining a natural posture where the vertebral column is kept in a straight line as looking from the front, but if viewed from a side perspective, the seven vertebrae of the cervical curve will appear in a curve in such a fashion to protrude forward. Therefore, the height of the pillow should also satisfy the arc length of such curve such that the cervical vertebrae can be maintained in a natural condition. Either a overshooting or low-pass pillow height can hardly keep the cervical vertebrae in a natural condition. This has been reported by users to be contributing to neck pain, or the so-called neck muscle spasm.

Medical experts have suggested that the pillow height for users lying with back on the floor to be kept between 5 to 8 cm as a best mode of practice. In another perspective, a majority of people cannot constantly remain in the same sleep posture while sleeping, for which the most common postures are lying on his/her back or on his/her side. As such, the most ideal pillow height, taking into consideration of each person's body type and shoulder width, gender, and age is between 8 to 10 cm. In another perspective, it is commonly known to best place the bottom edge of the pillow close to user's shoulder, and keep away from suspending the cervical vertebrae and back in mid-air. It will be understood to persons skilled in the art that such arrangement is sufficient to provide proper weight support and pressure relief.

Traditional pillows are known to be equal and symmetrical in terms of their shape, and the pillow surface used mainly for supporting user's head (particularly back of head) is a flat surface, and the majority of these traditional pillows tend not to be designed by ergonomical standards and without consideration of adapting to human body curves. Pillow surface highly suitable for back lying may appear to be slightly low for side lying. There has been proposed a memory pillow made from memory cotton, of which the central area is a flat surface, the edge of which has winding protrusions and is higher than the pillow surface such that the edge having protrusions can support weight of back of user's neck. However a disadvantage of the such design is suitable only for the back lying sleep posture because the protruding edge will become higher than the flat pillow surface in the middle, and such arrangement can cause the side of user's head (especially ears) to be turned to an inappropriate downward inclination posture.

U.S. Pat. No. 6,006,380 (hereinafter referred to as "cited reference") discloses an adjustable cervical pillow with depression for a user's ear. The technical feature of the cited reference entails "an adjustable cervical pillow, with beautification properties, for supporting the head and neck of a person. The cervical pillow includes a resilient pillow body with a resilient upper portion that includes a plurality of depressions on a top face of the resilient upper portion for receiving a person's ear during use. The pillow body further includes a central depression and at least one head adjusting shim. The top face includes a raised cervical support region for supporting the neck of a user during use." As those indicated in FIG. 3 and FIG. 4, the pillow is a solid-bodied pillow made from urethane foam, and the top head height adjustment includes raised cervical support region for supporting the base of the skull and neck. As a result, the pillow can support the weight of the user's head by way of the pillow's overall support capacity. However, this design will not work to deliver a shock-absorbing functionality, because it can only provide a structural support to the user's neck. Moreover, the pillow is solid-bodied, as such it is not equipped with a space designed for allowing air ventilation, and therefore it is not capable of distributing heat. The cited reference is designed to only support the user's neck by way of adjusting the height of the user's neck, but cannot offer other benefits including pressure distribution, shock absorbance, and air-ventilation-mediated heat distribution.

SUMMARY OF THE INVENTION

In order to solve the aforementioned issue raised by traditional arts in the field of pillow technology and to provide better health and comfort benefits, the present invention provides an ergonomical pillow for head rest having a capability to stabilize a user's head position such that the user can be saved from undesirable neck muscle spasm, while at the same time keeping a uniform pressure relief to the user to also provide comfort and excellent sleep quality.

An embodiment of the ergonomical pillow for head rest of the present invention comprises:

a pillow surface, which is a sheet-like element made from a soft buffer material;

a shock absorbing and pressure relief cushion, which is a sheet-like element made from a shock absorbing and pressure relief material; and a pillow, wherein the pillow is made from a soft buffer material, and has at least a hollow compartment, the hollow compartment is located in an essential position on the pillow for supporting the weight of a user's head, wherein when a user's head is lying on the pillow surface sitting above the hollow compartment, the pillow surface and shock absorbing and pressure relief cushion will settle into the hollow compartment due to weight of user's head. This also will guide the user to move his/her shoulder near the bottom edge of the pillow to avoid neck muscle spasm, and will offer comfort and excellent sleep quality through the shock absorbing and pressure relief cushion beneath the pillow surface.

According to an embodiment of the present invention, the pillow has a first hollow compartment and a left hollow compartment and right hollow compartment deposed respectively on the two sides of the first hollow compartment. The first hollow compartment is located on an essential location of the pillow for supporting the weight of a user's head. The first hollow compartment is suitable for use in supporting rear side of head, the depth of the left hollow compartment and right hollow compartment are smaller than the first hollow compartment, which can support head's side surface when the user is lying on his/her side. The level of settlement of head depends on the user's body type and weight, and the pillow can provide suitable support when the user is either lying on his/her side or back.

According to a structure of an embodiment of the present invention, the shock absorbing and pressure relief cushion can be made from shock absorbing and pressure relief material selected from a gel or silicon.

According to an embodiment, the soft butter material for making the pillow can be selected from foam, high density foam, and latex.

As will be understood from the above disclosure, the ergonomic pillow for head rest of the present invention has at least a hollow compartment on the main distribution location of the weight of the user's head. When the user's head is lying on the pillow surface above the hollow compartment of the pillow, the pillow surface and the shock absorbing and pressure relief cushion covering the top of the hollow compartment will settle into the hollow compartment due to weight of user's head. This type of pillow surface is capable of stabilizing user's head, and can place the head and neck in an appropriate location, and further guiding user's shoulder to be near the bottom edge of the pillow in order to avoid neck muscle spasm. In another embodiment of the present invention, hollow compartments of different depth are used, which can provide appropriate support depending on body type, and offer uniform pressure relief through the shock absorbing and pressure relief cushion beneath the pillow surface.

These features and advantages of the present invention will become fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE PREFERRED EMBODIMENTS

Figure 1:
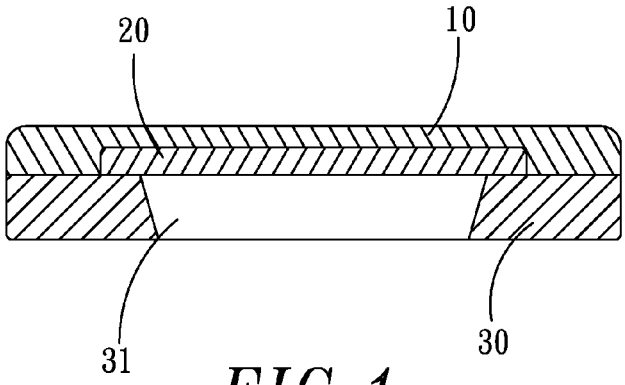
FIG. 1 is an embodiment of the present invention, showing a cross-sectional structure of the ergonomical pillow for head rest.
Figure 11:
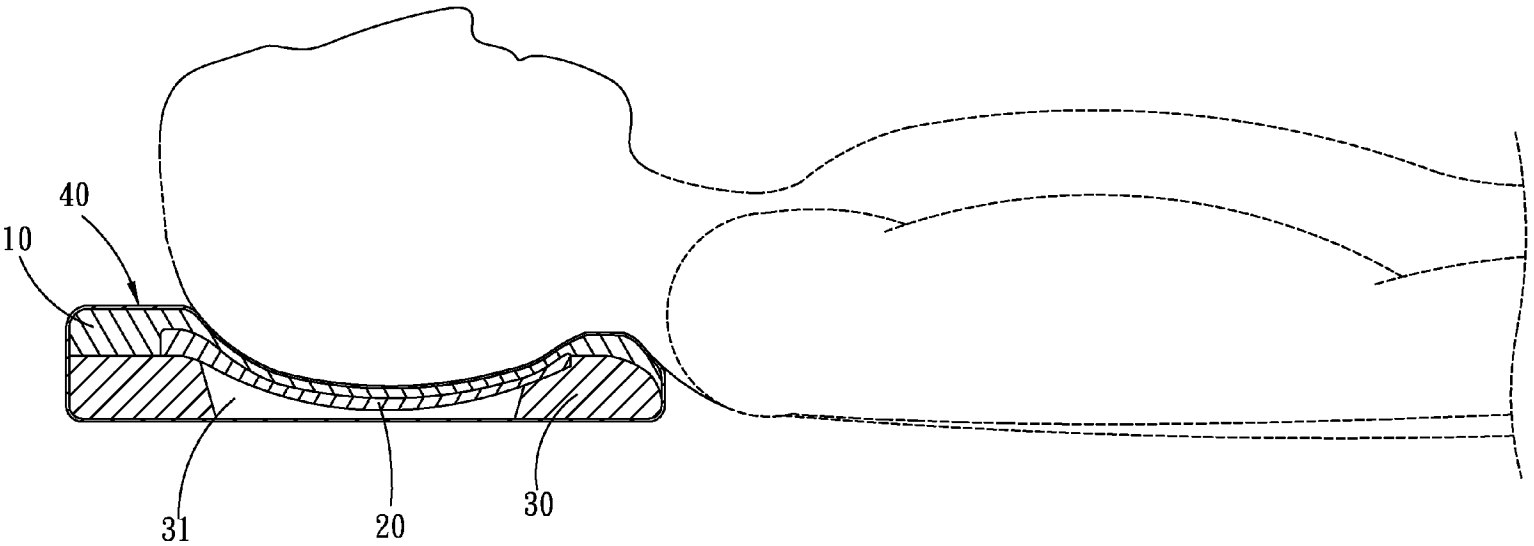
FIG. 11 demonstrates a situation when the ergonomical pillow for head rest of the present invention is in use, showing a user's head settling into a hollow compartment when the user is in a back-lying position.

Referring now to FIG. 1, an embodiment for an ergonomic pillow for head rest according to the present invention comprises:

a pillow surface 10, which is a sheet-like element made from a soft buffer material;

a shock absorbing and pressure relief cushion 20, which is a sheet-like element made from a shock absorbing and pressure relief material, which can selected from gel and silicon; and a pillow 30, wherein the pillow 30 is made from a soft buffer material, and the pillow 30 has at least one hollow compartment 31, the hollow compartment 31 is located on the essential distribution location of a user's weight, such is suitable for use in supporting back of user's head. The shock absorbing and pressure relief cushion 20 covers the top of the hollow compartment 31, the pillow surface 10 covers the top of the shock absorbing and pressure relief cushion 20, pillow surface 10 is attached to the shock absorbing and pressure relief cushion 21 and pillow 30 with a glue-based connecting means. When the user's head is lying on the pillow surface 10 above the hollow compartment 31, the pillow surface 10 and the shock absorbing and pressure relief cushion 20 covering on top of the hollow compartment 31 will settle into a groove 31 due to the weight of the user's head (as shown in FIG. 11).

Gel is a polymeric compound that can have properties ranging from excellent pressure conduction and shock absorbability, and can also be a copolymer, and shows high thermoplasticity. An example of which is SEBS (Styrene Ethylene Butadiene Styrene) related formulation as it can form an elastic gel by formulations for adjusting its hardness depending on actual needs, which has low elasticity and is therefore particularly suitable for producing highly soft pressure relief material. In an embodiment of the present invention, the surface of a shock absorbing pressure relief cushion 20 can be set up to have network of protrusions (as shown in FIG. 3), and can also be set up to have a texture of a bulb-like structure, which can serve to provide a massaging function, or making the shock absorbing pressure relief cushion into a solid body having a planar surface.

According to an embodiment of the present invention, the soft buffer material used in producing a pillow 30 can be selected from a group of foam, high density foam, and latex.

Figure 2:
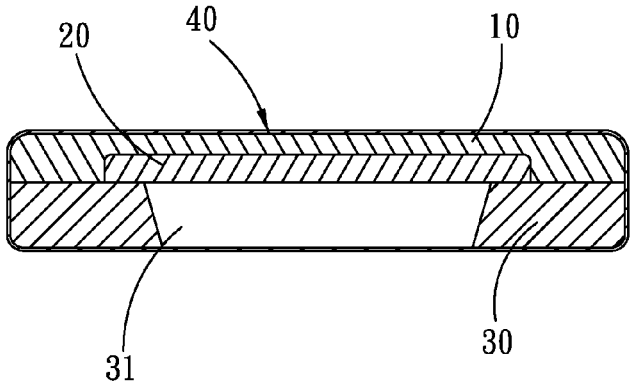
FIG. 2 is another embodiment of the present invention, showing a cross-sectional structure of the ergonomical pillow for head rest having a covering player.

According to another embodiment of the present invention, the exterior surface of the pillow 10 and pillow 30 has a covering layer 40 (as shown in FIG. 2), the covering layer 40 can be selected from a group consisting of a man-made leather (ex. PVC or PU man-made leather), man-made fabric cloth, and natural fabric cloth.

Figure 3:
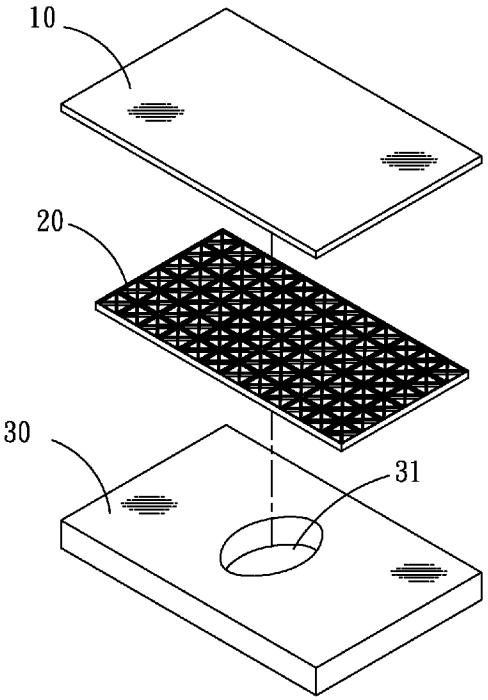
FIG. 3 is a schematic diagram for an embodiment of the pillow of FIG. 2, showing the construction elements of the pillow.
Figure 4:
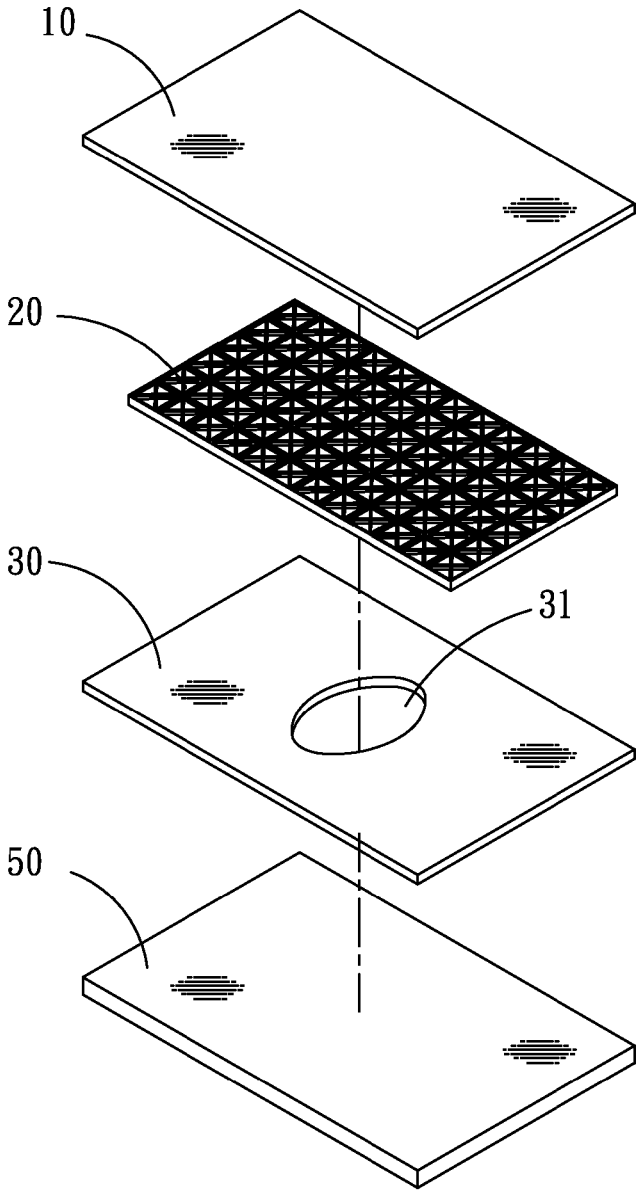
FIG. 4 is a schematic diagram for another embodiment of the pillow of FIG. 2, showing the construction elements of the pillow.

In practice when producing an embodiment for the pillow 30 as in FIG. 2, which is shown in FIG. 3, a processing technology (ex. cutting) is used to form a hollow compartment 31 on the pillow 30, the hollow compartment 31 can conduct through the pillow 30 along the direction the user's head applies to the pillow 30, the shock absorbing pressure relief cushion 20 covers the top of the hollow compartment 31, and the pillow surface 10 covers additionally on top of the shock absorbing and pressure relief cushion 20. FIG. 4 is the structure of another embodiment of the ergonomic pillow for head rest of the present invention, wherein the bottom of the pillow 30 has a support cushion 50, with which the support cushion 50 can increase the height of the ergonomic pillow for head rest of the present invention. Support cushion 50 is another sheet-like element made from soft buffer material, and the support cushion 50 can be attached to the bottom of the pillow 30 through a connecting means including taping.

Figure 5:
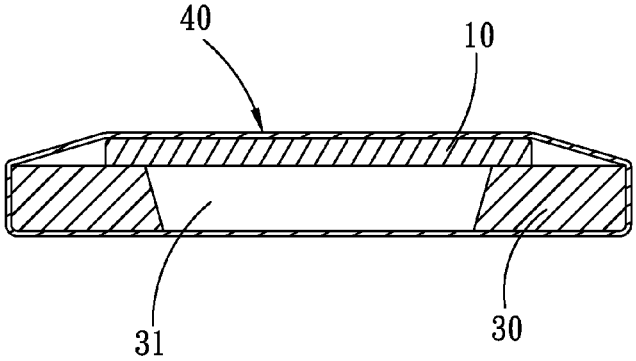
FIG. 5 is another embodiment of the present invention, showing a cross-sectional structure of the ergonomical elements of the pillow.

Referring now to FIG. 5, a structure for another embodiment of the ergonomic pillow for head rest of the present invention is provided, further comprising:

a shock absorbing and pressure relief cushion 20, which is a sheet-like element made from a shock absorbing and pressure relief material, and can be a material selected from the group consisting of gel, silicon;

a pillow 30, the pillow 30 is made by soft buffer material, the pillow 30 can have at least a hollow compartment 31, the hollow compartment 31 is located on essential locations for weight of user's head, so as to support back of user's head, the shock absorbing and pressure relief cushion 20 covers the top of the hollow compartment 31; and a covering layer 40, which covers exterior surfaces of the pillow 30 and the shock absorbing and pressure relief cushion 20.

According to yet another embodiment of the present invention, the covering layer 40 and shock absorbing and pressure relief cushion 20 can be disposed of a plurality of through-out ventilation pores, making the ergonomic pillow for head rest of the present invention better ventilated.

Figure 6:
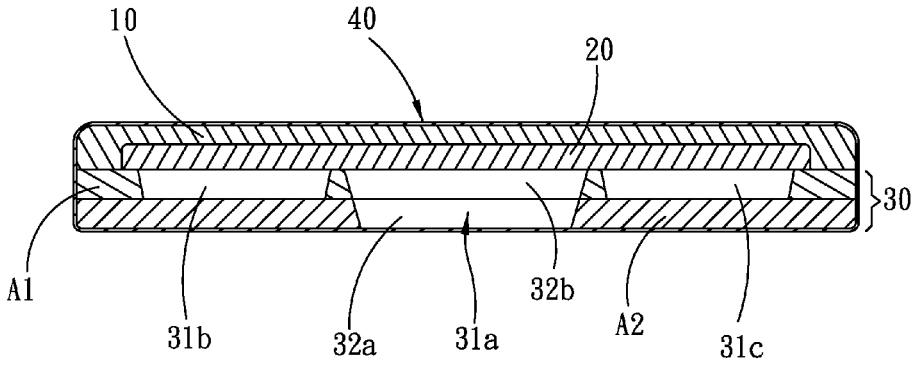
FIG. 6 is yet another embodiment of the present invention, showing a cross-sectional structure of the ergonomical elements of the pillow.
Figure 12:
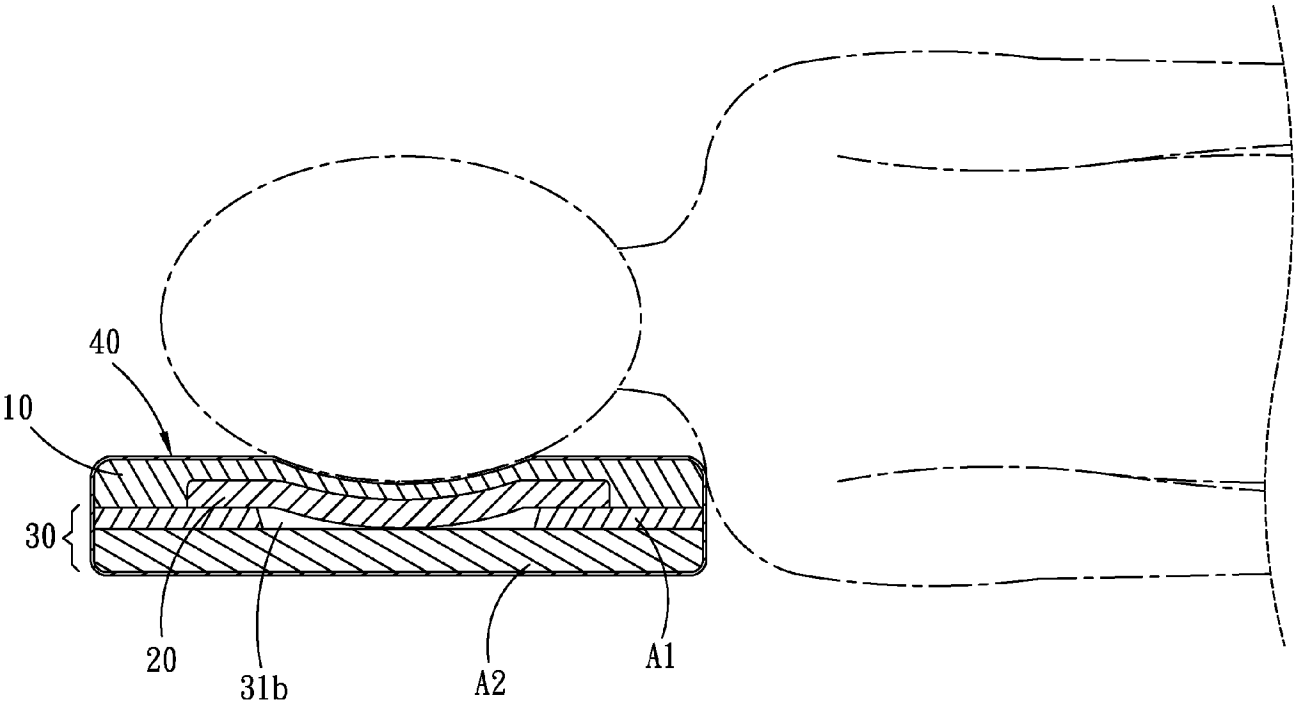
FIG. 12 demonstrates a situation when the ergonomical pillow for head rest of the present invention is in use, showing a user's head settling into a left hollow compartment when the user is in a side-lying position.

FIG. 6 is a schematic diagram showing yet another embodiment of the present invention, comprising:

a pillow surface 10, which is a sheet-like element made from a soft buffer material;

a shock absorbing and pressure relief cushion 20, which is a sheet-like element made from a shock absorbing and pressure relief cushion, which is made by a material selected from a group consisting of gel and silicon; and a pillow 30, the pillow 30 is made by a soft buffer material, the pillow 30 has a first hollow compartment 31*a* and a left hollow compartment 31*b* and a right hollow compartment 32 disposed respectively on two sides of the first hollow compartment 31*a*, the first hollow compartment 31*a* provides support to weight of a user's head on essential locations of the pillow 30, wherein the first hollow compartment 31*a* is suitable for supporting back of head, the depth of the left hollow compartment 31*b* and the right hollow compartment 31*c* is smaller than the first hollow compartment 31*a*, which can offer support to a side of head when the user is lying on his/her side (see FIG. 12). The shock absorbing and pressure relief covers the first hollow compartment 31*a*, left hollow compartment 31*b* and right hollow compartment 31*c*. The pillow surface 10 covers on top of the shock absorbing and pressure relief cushion 20, and is attached to the pillow 30 through a connecting means including taping. When the user is lying on his/her back, the user's head resets on the pillow surface 10 above the first hollow compartment 31*a*, the pillow surface 10 and the shock absorbing and pressure relief cushion 20 covering on top of the first hollow compartment 31*a* will settle downward into the first hollow compartment 31*a* due to the weight of the user's head. When the user is lying on his/her side, regardless of the direction to which the user faces, the user can choose to from using the left hollow compartment 31*b* and the right hollow compartment 31*c* for supporting the side of the user's head. Although it may appear apparent to some that the shoulder width of the user when he/she is lying on his/her side, the width of which may cause the height of the neck to be slightly higher than that when the user is lying on his/her back, such disadvantage may be solved with the present invention to provide appropriate support for body type as the depth of the left hollow compartment 31*b* and the right hollow compartment 31*c* are smaller than the first hollow compartment 31*a*.

As can be understood from FIG. 6 and FIG. 11, when the user rests upon the covering layer 40 covering the pillow 30 and the shock absorbing and pressure relief cushion 20, with further reference to FIG. 6, the shock absorbing and pressure relief cushion 20 will be depressed by way of the weight of the user's head. Because the underside of the shock absorbing and pressure relief cushion 20 is equipped with the first central compartment 32*a* and the second central compartment 32*b*, the pillow can support to the user's head when the shock absorbing and pressure relief cushion 20 is depressed due to the weight of the user's head. Also, as permitted by the depth range of the first hollow compartment 31*a*, the shock absorbing and pressure relief cushion 20 will not cause the user's head to depress enough to touch a lowest bottom, so as to make the user's neck dangled by way of the shock absorbing and pressure relief cushion 20.

As shown in FIG. 2 and FIG. 4 of the cited reference, U.S. Pat. No. 6,006,380, the structure of each layer is solid-bodied, and does not contain any hollow compartment. As a result when the user's head is laying upon the pillow, there is no space for air to ventilate, thereby making the invention covered in the cited reference incapable of distributing heat built up within the invention of the cited reference. Different from the foregoing invention, one embodiment of the present invention as disclosed in FIG. 6 and FIG. 11 shows that the first hollow compartment 31*a* is designed with a hollow structure. As such air can ventilate well through the first hollow compartment 31*a*. When air is present within the first hollow compartment 31*a*, and when the weight of the user's head depresses, the first hollow compartment 31*a* will structure itself into an air-bag-like structure. The air-bag-like structure works to support the underside of the absorbing and pressure relief cushion 20.

Even more, the recess of the sides of the cited reference is provided for accepting the user's ears, such that the user's ears will not be held constrained underneath the user's head when user is lying on his or her side during sleep. In the case with the present invention, the top surface of the left hollow compartment 31*b* and the right hollow compartment 31*c* are covered by the shock absorbing and pressure relief cushion 20, such that there is no room for accommodating the user's ears. The advantage of current invention comes from the structural design allowing for either side of the user's face to be dangled by way of the shock absorbing and pressure relief cushion 20. This design can also allow for either side of the user's face to receive a sensual feeling functionally equivalent as "shock-absorbing" and "pressure-relieved". The cited reference cannot achieve the aforementioned advantage offered by the current invention.

By way of the above, the pillow 30 of the current invention is equipped with a first hollow compartment 31*a*, left hollow compartment 31*b*, and right hollow compartment 31*c*. The purpose of this setup is to create a configurable space in the shock absorbing and pressure relief cushion 20, so that the user's head can find its support by way of dangling when the user is asleep. Further, the current invention can benefit from the installment of the first hollow compartment 31*a*, left hollow compartment 31*b*, and right hollow compartment 31*c* to realize an air ventilating effect.

Figure 7:
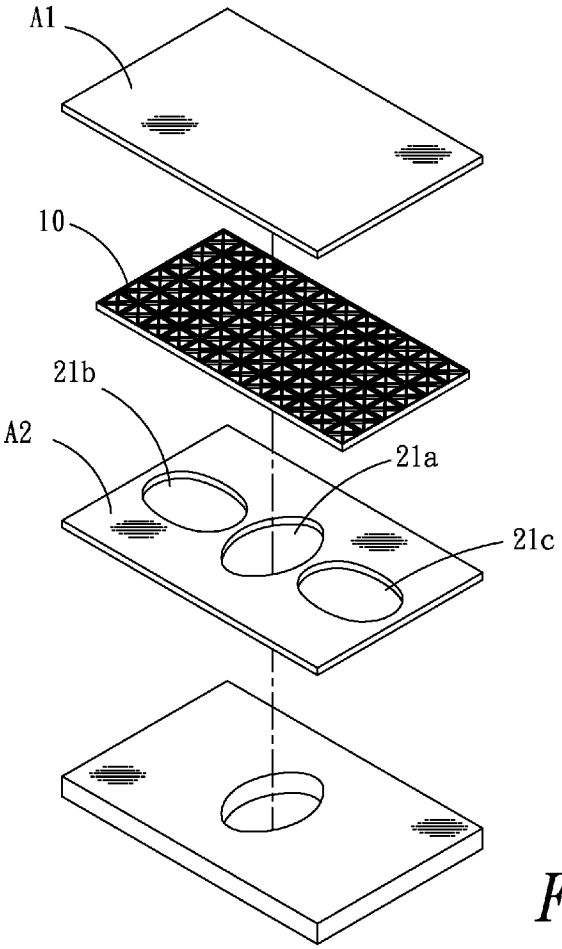
FIG. 7 is a schematic diagram for an embodiment of the pillow of FIG. 6, showing the construction elements of the pillow.

Another embodiment of the pillow 30 as shown in FIG. 6 is shown in FIG. 7, the pillow 30 has a top layer material A1 and a bottom layer material A2 that are made from soft buffer material and overlap with each other. The top layer material A1 and the bottom layer material A2 can be attached together through a connecting means including taping, wherein a processing technology (ex. cutting) forms a first central compartment 32*a* on the essential locations from which the bottom layer material A2 support the weight of the user's head. The top layer material A1 forms a second central compartment 32*b* on the essential locations from which the top layer material A1 support the weight of the user's head. There are also disposed on two sides of the second central compartment 32*b* a left hollow compartment 31*b* and a right hollow compartment 31*c*, wherein the left hollow compartment 31*b* and the right hollow compartment 31*c* all passes through the top layer material A1. The second central compartment 32*b* passes through top of the first central compartment 32*a* and connects with the first central compartment 32*a*, and the first central compartment 32*a* and the second central compartment 32*b* constitute the first hollow compartment 31*a*. The shock absorbing and pressure relief cushion 20 covers the top of the first hollow compartment 31*a*, the left hollow compartment 31*b* and the right hollow compartment 31*c*. The pillow surface 10 then covers the top of the shock absorbing and pressure relief cushion 20. The depth of the first hollow compartment 31*a*, left hollow compartment 31*b* and the right hollow compartment 31*c* are set out to be different as a result of the abovementioned structuring arrangement.

Figure 8:
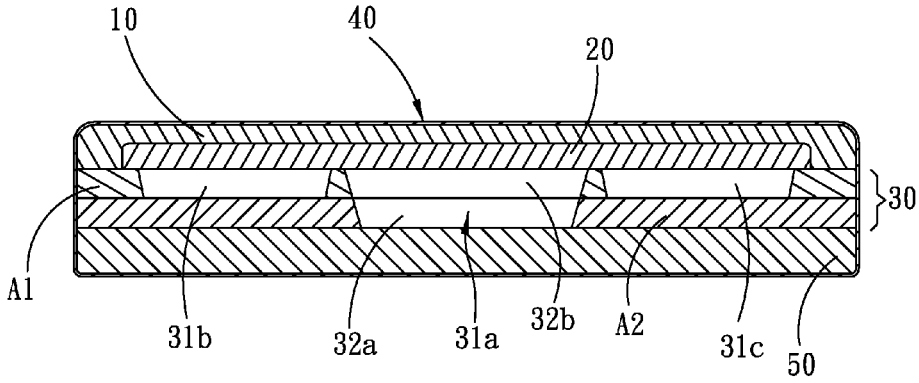
FIG. 8 is another embodiment of the present invention, showing a cross-sectional structure of the ergonomical pillow having pressure relief capability.
Figure 9:
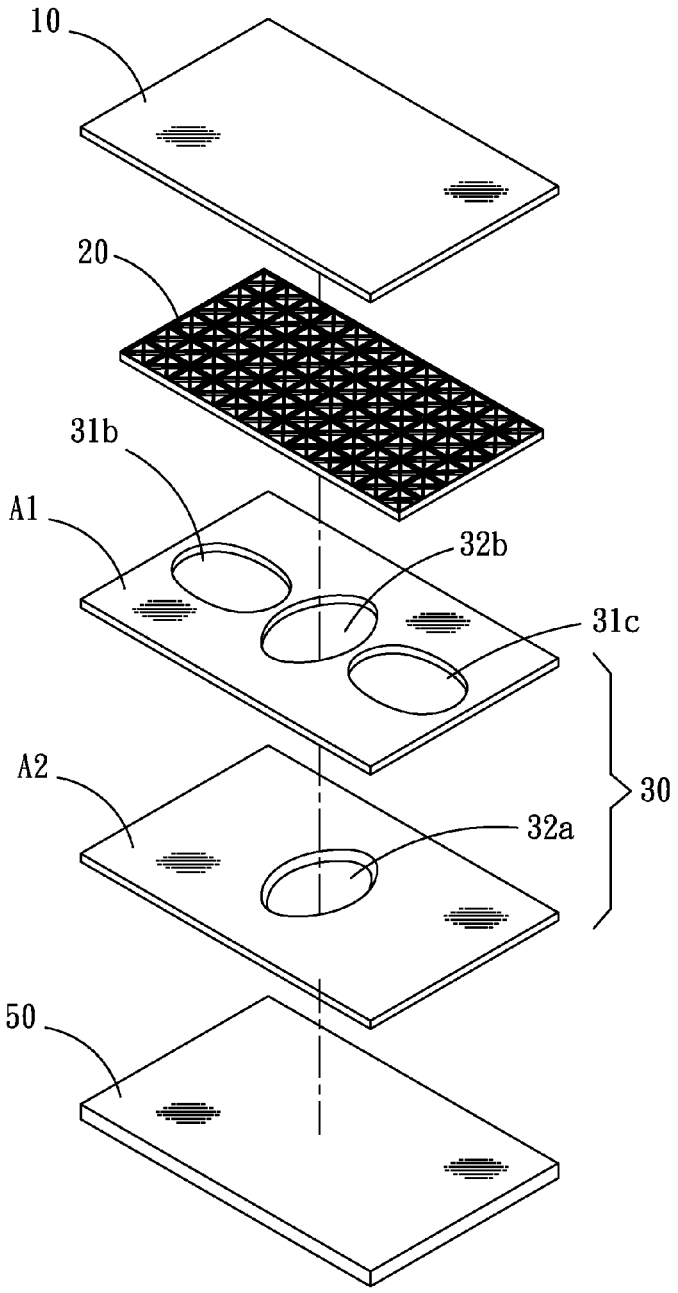
FIG. 9 is a schematic diagram for the pillow of FIG. 8, showing the construction elements of the pillow.

FIG. 8 and FIG. 9 show another embodiment of the pillow 30 of FIG. 6, wherein the bottom of the pillow 30 has a support cushion 50, and the height of the ergonomic pillow for head rest is increased by use of the support cushion 50. The support cushion 50 is a sheet-like element made from a soft buffer material, and the support cushion 50 can be attached to the bottom of the pillow 30 through a connecting means including taping.

Figure 10:
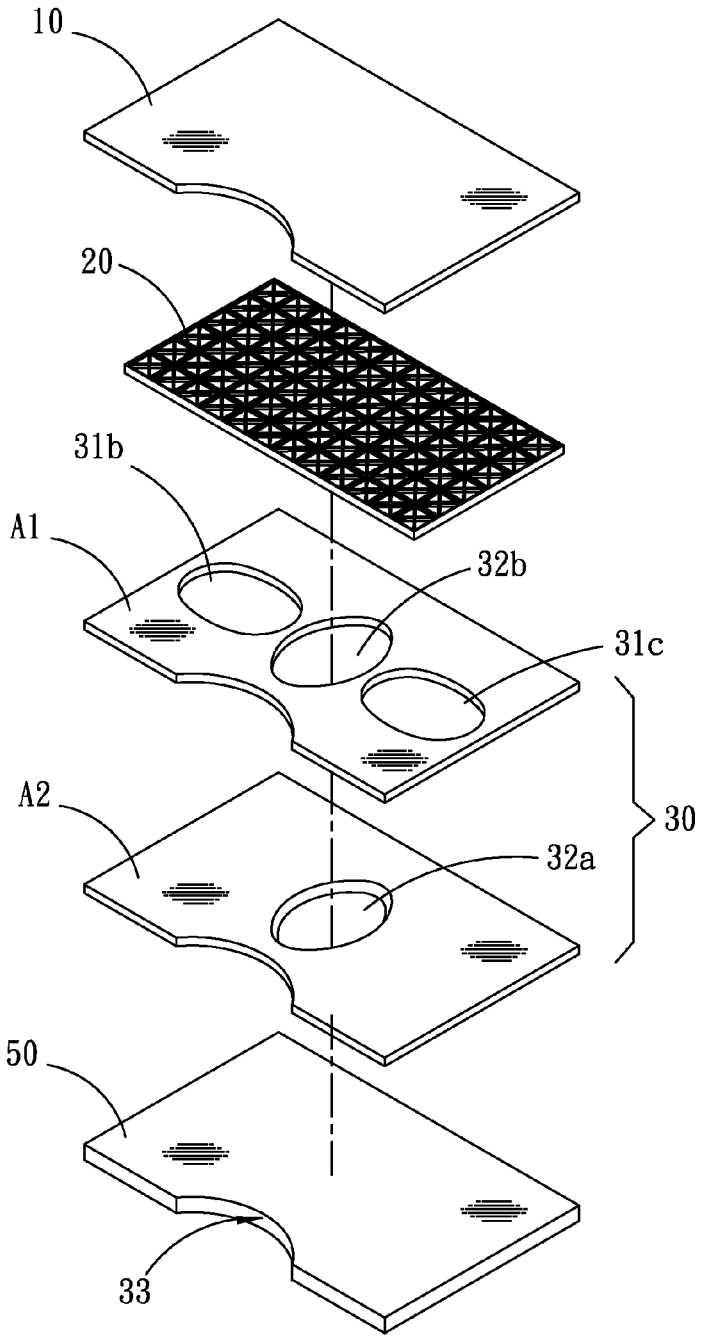
FIG. 10 is an illustrative diagram of another embodiment of the present invention, showing an arc-like groove on an edge of the ergonomical pillow having pressure relief capability.

FIG. 10 is an illustrative diagram of another embodiment of the present invention, wherein the edge of the pillow 30 has an arc-like groove 33, the groove 33 is made in such a way to respond to the back of the user's neck such that the bottom edge of the ergonomic pillow falls near the user's shoulder, providing appropriate support to cervical vertebrae and user's back.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An ergonomic pillow for head rest, comprising:

a pillow comprising soft buffer material, and having a first hollow compartment, a left hollow compartment, and a right hollow compartment inside, with the left and right hollow compartments disposed on two opposite sides of the first hollow compartment, wherein the first hollow compartment extends away from a top surface of the pillow by a first depth, the left hollow compartment extends away from the top surface by a second depth, the right hollow compartment extends away from the top surface by a third depth, the first hollow compartment is disposed in an essential location configured to be in alignment with a user's head, and the first depth larger than the second and third depths;

a shock absorbing and pressure relief cushion being a sheet-like element and covering the pillow, wherein the shock absorbing and pressure relief cushion has a bottom surface connecting to the top surface of the pillow and covering the first, left and right hollow compartments, and the shock absorbing and pressure relief cushion further has a top surface opposite to the bottom surface and adapted to face the user's head; and a covering layer covering the shock absorbing and pressure relief cushion;

wherein the pillow has a top layer material and a bottom layer material that are made from soft buffer material and overlap with each other, wherein the top layer material and the bottom layer material connect with each other, wherein the bottom layer material forms a first central compartment, wherein the top layer material forms a second central compartment in connection with the first central compartment so that the first and second central compartments jointly form the first hollow compartment, wherein the left hollow compartment and the right hollow compartment are formed in the top layer material on two opposite sides of the second central compartment.

2. The ergonomic pillow for head rest of claim 1, wherein an edge of the pillow has an arc-like groove adaptable to a back of the user's head.

3. The ergonomic pillow for head rest of claim 1, wherein the soft buffer material used for producing the pillow is selected from the group consisting of a foam, high density foam, and latex.

4. The ergonomic pillow for head rest of claim 1, wherein the shock absorbing and pressure relief cushion is made from a material selected from the group consisting of gel and latex.

5. The ergonomic pillow for head rest of claim 1, wherein the covering layer is made from a material selected from the group consisting of man-made leather, man-made fabric cloth, and natural fabric cloth.

6. The ergonomic pillow for head rest of claim 5, wherein the man-made leather is made from a material selected from a group consisting of PVC man-made leather and PU man-made leather.

7. An ergonomic pillow for head rest, comprising:

a pillow surface, which is a sheet-like element made from a soft buffer material;

a pillow comprising soft buffer material, and having a first hollow compartment, a left hollow compartment, and a right hollow compartment inside, with the left and right hollow compartments disposed on two opposite sides of the first hollow compartment, wherein the first hollow compartment extends away from a top surface of the pillow by a first depth, the left hollow compartment extends away from the top surface by a second depth, the right hollow compartment extends away from the top surface by a third depth, the first hollow compartment is disposed in an essential location configured to be in alignment with a user's head, and the first depth is larger than the second and third depths;

a shock absorbing and pressure relief cushion being a sheet-like element and covering the pillow, wherein the shock absorbing and pressure relief cushion has a bottom surface connecting to the top surface of the pillow and covering the first, left and right hollow compartments, and the shock absorbing and pressure relief cushion further has a top surface opposite to the bottom surface and adapted to face the user's head; and a covering layer covering the shock absorbing and pressure relief cushion;

wherein the pillow surface is arranged between the shock absorbing and pressure relief cushion and the covering layer;

wherein the pillow has a top layer material and a bottom layer material that are made from soft buffer material and overlap with each other, wherein the top layer material and the bottom layer material connect with each other, wherein the bottom layer material forms a first central compartment, wherein the top layer material forms a second central compartment in connection with the first central compartment so that the first and second central compartments jointly form the first hollow compartment, wherein the left hollow compartment and the right hollow compartment are formed in the top layer material on two opposite sides of the second central compartment.

8. An ergonomic pillow for head rest, comprising:

a pillow comprising soft buffer material, and having a first hollow compartment, a left hollow compartment, and a right hollow compartment inside, with the left and right hollow compartments disposed on two opposite sides of the first hollow compartment, wherein the first hollow compartment extends away from a top surface of the pillow by a first depth, the left hollow compartment extends away from the top surface by a second depth, the right hollow compartment extends away from the top surface by a third depth, the first hollow compartment is disposed in an essential location configured to be in alignment with a user's head, and the first depth is larger than the second and third depths;

a shock absorbing and pressure relief cushion being a sheet-like element and covering the pillow, wherein the shock absorbing and pressure relief cushion has a bottom surface connecting to the top surface of the pillow and covering the first, left and right hollow compartments, and the shock absorbing and pressure relief cushion further has a top surface opposite to the bottom surface and adapted to face the user's head a support cushion being a sheet-like element made from a soft buffer material and is attached to a bottom of the pillow, wherein the bottom is opposite to the first surface of the pillow; and a covering layer covering the shock absorbing and pressure relief cushion;

wherein the pillow has a top layer material and a bottom layer material that are made from soft buffer material and overlap with each other, wherein the top layer material and the bottom layer material connect with each other, wherein the bottom layer material forms a first central compartment, wherein the top layer material forms a second central compartment in connection with the first central compartment so that the first and second central compartments jointly form the first hollow compartment, wherein the left hollow compartment and the right hollow compartment are formed in the top layer material on two opposite sides of the second central compartment.

9. The ergonomic pillow for head rest of claim 8 further comprising a pillow surface being a sheet-like element made from a soft buffer material, wherein the pillow surface is arranged between the shock absorbing and pressure relief cushion and the covering layer.

* * * * *